US008870554B2

(12) United States Patent
Kent

(10) Patent No.: US 8,870,554 B2
(45) Date of Patent: Oct. 28, 2014

(54) PUMP WITH WEAR SLEEVE

(75) Inventor: Gerald Edward Kent, Edmonton (CA)

(73) Assignee: Allen R. Nelson Engineering (1997) Inc., Edmonton (CA)

( * ) Notice: Subject to any disclaimer, the term of this patent is extended or adjusted under 35 U.S.C. 154(b) by 62 days.

(21) Appl. No.: 13/237,824

(22) Filed: Sep. 20, 2011

(65) Prior Publication Data

US 2013/0071256 A1 Mar. 21, 2013

(51) Int. Cl.
*F04B 49/10* (2006.01)

(52) U.S. Cl.
CPC ..... *F04B 49/10* (2013.01)
USPC ..... 417/559; 137/375

(58) Field of Classification Search
CPC ..... F04B 49/10; F04B 49/1087
USPC ..... 417/44.3, 415, 454, 559; 92/71; 137/516.27, 516.29, 375
See application file for complete search history.

(56) References Cited

U.S. PATENT DOCUMENTS

| | | | | |
|---|---|---|---|---|
| 2,015,529 | A | 9/1935 | Lelgemann | |
| 3,015,529 | A | 11/1959 | Hardcastle | |
| 3,251,602 | A | 5/1966 | Williams | |
| 3,560,053 | A | 2/1971 | Ortloff | |
| 3,992,131 | A | 11/1976 | Masterman | |
| 4,337,017 | A | 6/1982 | Evenson | |
| 4,585,171 | A | 4/1986 | Schmidt | |
| 4,705,459 | A * | 11/1987 | Buisine et al. | 417/53 |
| 4,771,801 | A | 9/1988 | Crump | |
| 5,013,219 | A | 5/1991 | Hicks | |
| 5,226,445 | A | 7/1993 | Surjaatmadja | |
| 5,299,921 | A | 4/1994 | Richter | |
| 6,382,940 | B1 * | 5/2002 | Blume | 417/571 |
| 6,910,871 | B1 * | 6/2005 | Blume | 417/571 |
| 7,186,097 | B1 * | 3/2007 | Blume | 417/454 |
| 7,213,641 | B2 | 5/2007 | McGuire | |
| 2004/0161353 | A1 * | 8/2004 | Fabbri | 417/569 |
| 2006/0228225 | A1 * | 10/2006 | Rogers | 417/63 |
| 2007/0041850 | A1 | 2/2007 | Ganzel | |
| 2007/0204991 | A1 * | 9/2007 | Loree et al. | 166/280.1 |
| 2010/0051258 | A1 | 3/2010 | McGuire | |

FOREIGN PATENT DOCUMENTS

WO 2007/098606 A1 9/2007

* cited by examiner

*Primary Examiner* — Bryan Lettman
(74) *Attorney, Agent, or Firm* — Christensen O'Connor Johnson Kindness PLLC

(57) ABSTRACT

A pump is disclosed, comprising: a pump block defining a cylinder in which a piston is mounted for reciprocation and positive displacement of fluids from an intake port of the pump block to a discharge port of the pump block; an intake valve located in the intake port of the pump block and a discharge valve located in the discharge port of the pump block; the intake valve having a valve plug that has a closed position in which the valve plug is seated on a valve seat in the intake port; a wear sleeve lining at least a portion of the intake port upstream of the valve seat; a pressure sensor upstream of the intake valve for detecting a pressure condition indicative of failure of the intake valve to provide a seal when the intake valve is in the closed position; and a controller responsive to the pressure sensor to send a signal to stop operation of the pump upon detection of the pressure condition.

22 Claims, 4 Drawing Sheets

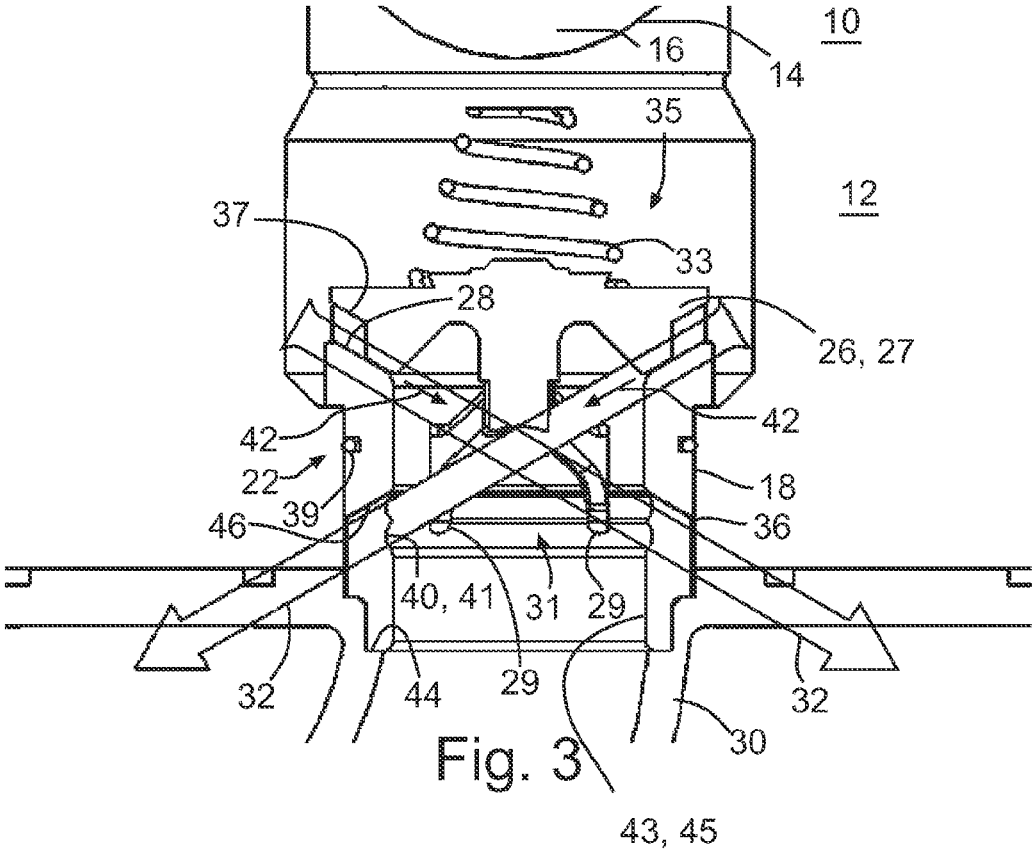
Fig. 3
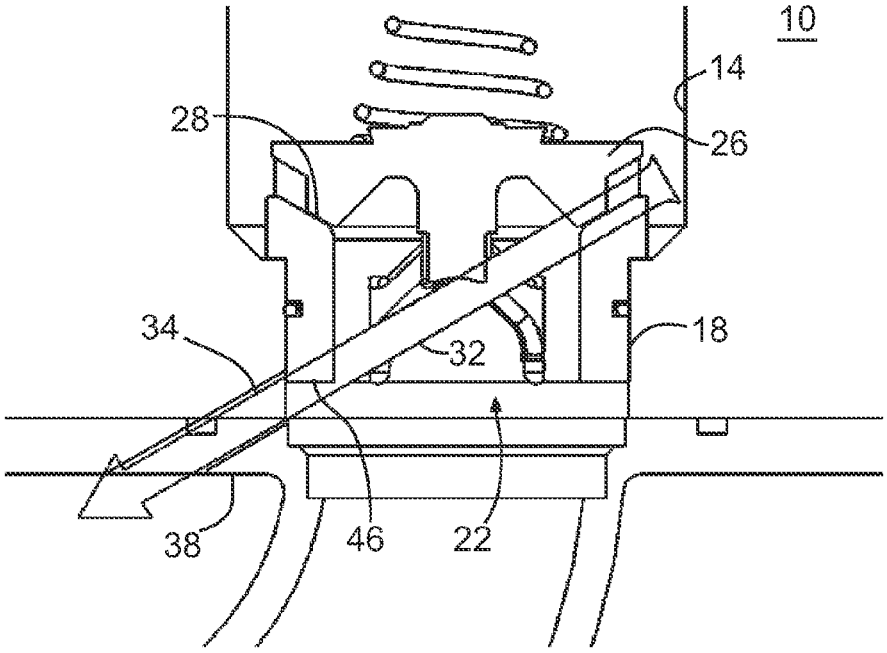
Fig. 4 - PRIOR ART

PUMP WITH WEAR SLEEVE

TECHNICAL FIELD

This document relates to pumps with wear sleeves.

BACKGROUND

Wear sleeves are used in tubulars and in pumps for long term protection from wear due to contact with abrasive particles carried in treatment fluids.

SUMMARY

A pump is disclosed, comprising: a pump block defining a cylinder in which a piston is mounted for reciprocation and positive displacement of fluids from an intake port of the pump block to a discharge port of the pump block; an intake valve located in the intake port of the pump block and a discharge valve located in the discharge port of the pump block; the intake valve having a valve plug that has a closed position in which the valve plug is seated on a valve seat in the intake port; a wear sleeve lining at least a portion of the intake port upstream of the valve seat; a pressure sensor upstream of the intake valve for detecting a pressure condition indicative of failure of the intake valve to provide a seal when the intake valve is in the closed position; and a controller responsive to the pressure sensor to send a signal to stop operation of the pump upon detection of the pressure condition.

In various embodiments, there may be included any one or more of the following features: The valve seat is conically tapered and the wear sleeve is disposed to intercept a set of lines, each line being tangent to the valve seat, that correspond to projected paths of a reverse flow jet that may form upon valve seal failure. The wear sleeve has a tapered inner surface. The tapered inner surface is concave. The tapered inner surface is scalloped. The tapered inner surface is linear. The discharge valve has a discharge valve plug that has a closed position in which the discharge valve plug is seated on a discharge valve seat in the discharge port and further comprising a discharge wear sleeve lining at least a portion of the discharge port upstream of the discharge valve seat. A pressure sensor is upstream of the discharge valve for detecting a pressure condition indicative of failure of the discharge valve to provide a seal when the discharge valve is in the closed position. The pump block defines plural cylinders and respective plural intake valves and discharge valves, and further comprising a manifold connected to supply treatment fluid to each intake port. The pressure sensor is located within the manifold. The pressure sensor is located within the intake port. The pressure sensor is located within a trunk of the manifold. The pressure sensor is located within an intake branch, of the manifold, connected to the intake port. The pump further comprises plural wear sleeves, with each wear sleeve lining at least a portion of the intake port upstream of the respective valve seat. The pump further comprises plural pressure sensors. Each pressure sensor is located upstream of the respective intake valve. One or more of the plural pressure sensors is located within the manifold. One or more of the plural pressure sensors is located within a respective intake port. The fluid is a fracturing fluid and the pump is connected to a source of the fracturing fluid. The fracturing fluid comprises gelled liquefied petroleum gas. The fracturing fluid comprises one or more of water, diesel oil, nitrogen, or other suitable fluids.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 3 is a side elevation section view of an intake port of a cylinder in a pump block, the intake port being lined with a wear sleeve upstream of the intake valve, and a projected path of a reverse flow jet that may form upon seal failure overlaid for reference.

FIG. 4 is a side elevation section view of a conventional intake port of a cylinder in a pump block without a wear sleeve.

DETAILED DESCRIPTION

Immaterial modifications may be made to the embodiments described here without departing from what is covered by the claims.

In the conventional fracturing of wells, producing formations, new wells or low producing wells that have been taken out of production, a formation can be fractured to attempt to achieve higher production rates. Proppant and fracturing fluid are mixed in a blender and then pumped into a well that penetrates an oil or gas bearing formation. High pressure is applied to the well, the formation fractures and proppant carried by the fracturing fluid flows into the fractures. The proppant in the fractures holds the fractures open after pressure is relaxed and production is resumed.

Care must be taken over the choice of fracturing fluid. The fracturing fluid must have a sufficient viscosity to carry the proppant into the fractures, should minimize formation damage and must be safe to use. A fracturing fluid that remains in the formation after fracturing is not desirable since it may block pores and reduce well production. For this reason, carbon dioxide has been used as a fracturing fluid because, when the fracturing pressure is reduced, the carbon dioxide gasifies and is easily removed from the well.

Various alternative fluids have been disclosed for use as fracturing fluids, including liquefied petroleum gas (LPG), which has been advantageously used as a fracturing fluid to simplify the recovery and clean-up of frac fluids after a frac. Exemplary LPG frac systems are disclosed in WO2007098606. However, LPG has not seen widespread commercial usage in the industry due to the perceived dangers associated with its use, and as a result conventional frac fluids such as water and frac oils continue to see extensive use.

Figure 1:
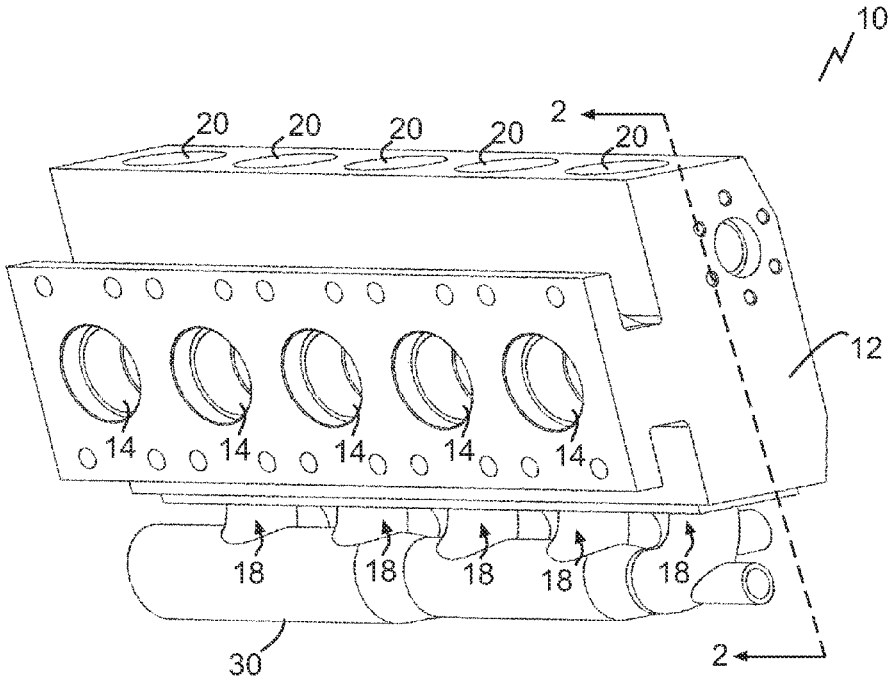
FIG. 1 is a perspective view of the pump block and intake manifold.
Figure 2:
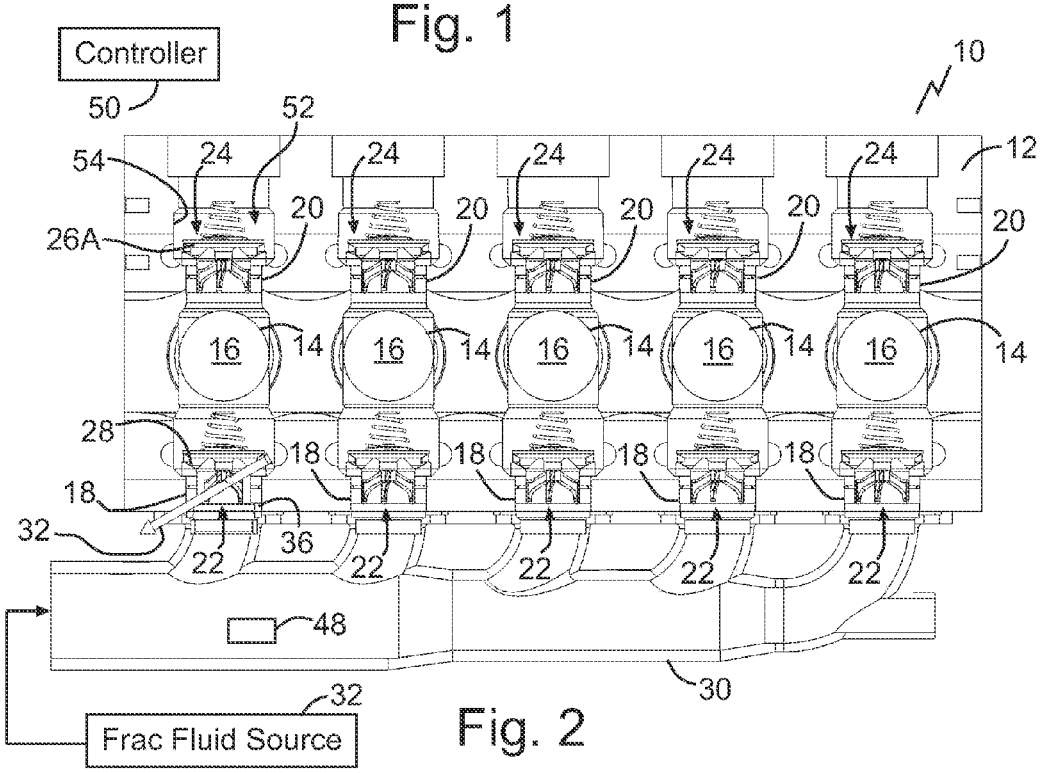
FIG. 2 is a section view taken along the 2-2 section lines of FIG. 1, with a wear sleeve positioned in the intake port of the left most cylinder, and a projected path of a reverse flow jet that may form upon seal failure overlaid for reference.

Referring to FIGS. 1, 2, and 3, treatment fluids such as fracturing fluids may be pumped downhole using a suitable pump 10, which may be a fracturing pump such as a triplex or quintuplex pump as shown. Pump 10 has a pump block 12 defining one or more cylinders 14 each in which a piston 16 is mounted for reciprocation and positive displacement of fluids from an intake port 18 of the pump block 12 to a discharge port 20 of the pump block 12. An intake valve 22 is located in the intake port 18 of the pump block 12 and a discharge valve 24 is located in the discharge port 20 of the pump block 12. Valves 22 and 24 may be one-way or check valves as is commonly used to operate a positive displacement pump. Referring to FIG. 3, the intake valve assembly 22 may include a valve plug 26, such as a valve disc 27, that has a closed position as shown in which the valve plug 26 is seated on a valve seat 28, which may be conically tapered as shown, in the intake port 18. Valve plug 26 may have one or more valve guide arms 29 on a low pressure side 31 of the valve 22, and a bias device such as a compression spring 33 on a high pressure side 35 of valve 22 for closing the valve 22 during compression. A retainer (not shown) may house a valve stem (not shown) connected to the plug 26 for centralizing the travel of plug 26 to ensure optimal closure with seat 28 during compression. One or more gaskets 37 may be fitted on plug 26 for sealing to seat 28 when closed. One or more gaskets 39 may be used to seal intake valve 22 within intake port 18. Referring to FIGS. 1 and 2, the pump block 12 as shown may define plural cylinders 14 and respective plural intake valves 22 and discharge valves 24, with the respective number of cylinders 14 being what generally gives the particular pump block 12 shown the name of a quintuplex pump. Other numbers of cylinders 14 may be used. A manifold 30 may be connected to supply treatment fluid to each intake port 18. A source 32 of fracturing fluid such as LPG may be connected to one or more intake port 18, for example through manifold 30. Various equipment (not shown) may be used for adding proppant and gelling chemicals to the frac fluid before the frac fluid enters pump 10.

A danger associated with LPG use is the risk of inadvertent fluid breakout resulting in the release of a highly explosive plume of pressurized LPG fluids into the atmosphere surrounding the worksite. Breakouts may be caused by pipe corrosion from proppant laden LPG pumped at high pressures during a fracturing operation. Referring to FIG. 4, seal failure across the sealing interface between the valve plug 26 and valve seat 28 of the intake valve 22 may cause such a breakout. Upon seal failure and during compression in the cylinder 14, a jet of pressurized proppant-laden fluid may form between the valve seat 28 and the valve plug 26 and travel along a projected path 32. This reverse ejection of the proppant laden jet into the low pressure intake port 18 may erode system components in the path 32 of the jet in a matter of minutes or less to bore a hole 34 to the exterior 38 of pump 10, through manifold 30, and into the atmosphere. One solution to this problem is to avoid passing proppant through pump 10 by adding proppant to the frac fluid post frac pump. However, this solution requires the careful coordination of plural frac pumps in parallel, and may require specialized proppant addition equipment.

Figure 7:
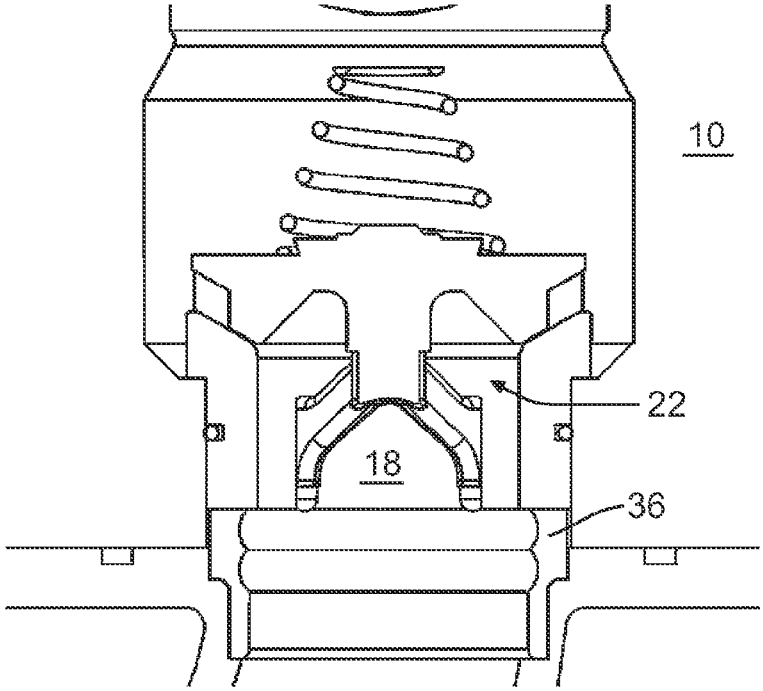
FIG. 7 is a side elevation view of a further embodiment of a wear sleeve positioned within an intake port of a pump block.
Figure 8:
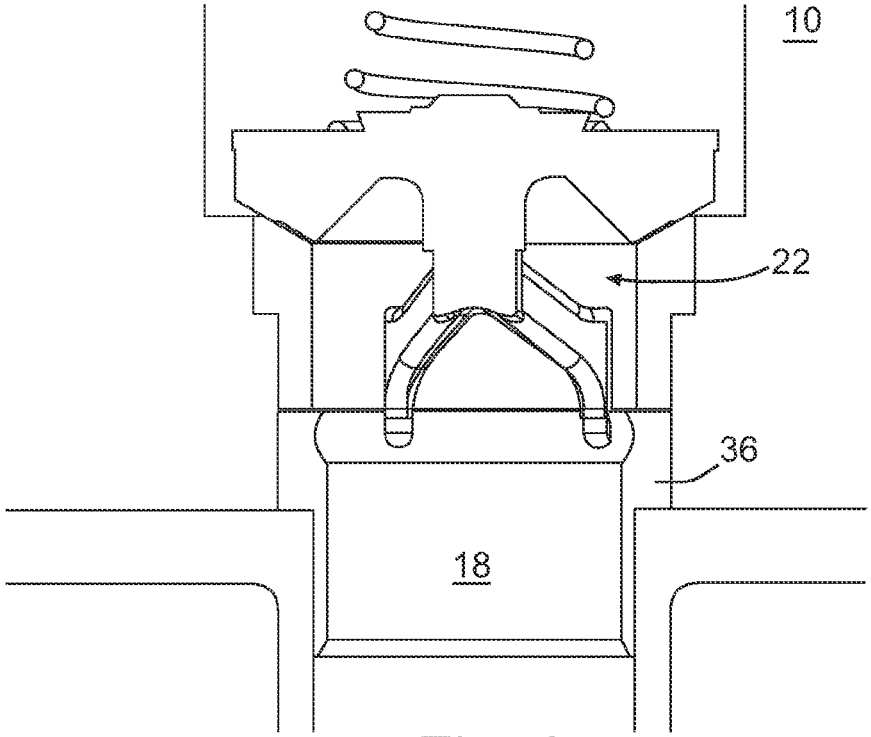
FIG. 8 is a side elevation view of a further embodiment of a wear sleeve positioned within an intake port of a pump block.

Referring to FIGS. 2 and 3, pump 10 may have a wear sleeve 36 lining at least a portion of the intake port 18 upstream of the valve seat 28. Wear sleeve 36 may be made of a suitable material, such as tungsten carbide, for resisting erosion of a reverse jet of proppant laden fluid described above. Referring to FIG. 3, wear sleeve 36 may be disposed to intercept a set of lines 42, each line 42 being tangent to the conically tapered valve seat 28, that correspond to projected paths 32 of a reverse flow jet that may form upon seal failure. The arrows 42 shown in FIG. 3 are for illustrative purposes only and indicate only two potential leak paths, although it should be understood that leak paths may originate from an infinite number of positions between seat 28 and plug 26 around the vertical axis of the valve 22. In practice a leak path may be directed at an angle relative to the tapered valve seat 28, although disposing wear sleeve 28 to intercept lines 42 is advantageous because seal failure is likely to occur between the seat 28 and plug 26 along a path tangent to the valve seat 28. The wear sleeve 36 may have a tapered inner surface 40, such as a scalloped surface 41 as shown, a concave surface, a linear surface, or another suitable surface, for at least partially deflecting the jet to reduce the penetrating force of the jet. In contrast to tapered inner surface 40, wear sleeve 36 may have at least a portion 43, of an inner surface 45, that has a constant diameter in the axial direction. Wear sleeve 36 may be held in place by friction or other suitable mechanisms, such as by being retained between opposed shoulders 44 and 46 within intake port 18. Other mechanisms may be used independently or in combination to retain the wear sleeve 36 in place, for example by securing the sleeve 36 with one or more fasteners or screws (not shown), or by use of one or more gaskets (not shown). Sleeve 36 may be designed to be retrofitted into intake port 18. Sleeve 36 may also be provided in some cases as integral with one or more parts of valve 22, for example if sleeve 36 and seat 28 are integral (not shown). In some cases, installation of sleeve 36 may require modifying shoulder 46 of intake valve 22 from the stock configuration of FIG. 4 to the modified configuration of FIG. 3 to fit sleeve 36, and to allow sleeve 36 to be positioned within paths 32 without unduly interfering with fluid flow as may occur on reduction of the minimum diameter of intake port 18. FIGS. 7 and 8 illustrate embodiments of wear sleeves 36 that may be designed to fit within intake port 18 without requiring modification of intake valve 22. Referring to FIG. 3, in use wear sleeve 36 may act as a shield for a reverse jet of proppant laden fluid travelling along path 32, lengthening the time interval between seal failure and system breakout. Wear sleeve 36 may also extend at least partially into manifold 30 as shown.

Referring to FIG. 2, pump 10 may further comprise a pressure sensor 48 and a controller 50. Sensor 48 may be positioned upstream of the intake valve 18 for detecting a pressure condition indicative of failure of the intake valve 22 to provide a seal when the intake valve 22 is in the closed position. The pressure sensor 48 may be located within the manifold 30 as shown. Controller 50 may be responsive to the pressure sensor 48 to send a signal to stop operation of the pump 10 upon detection of the pressure condition. Wired or wireless connections (not shown) may be provided between sensor 48, controller 50, and pump 10. Controller 50 may control normal operation of pump 10, or may be a peripheral shut off system designed to override normal pump controls.

Wear sleeve 36 effectively buys more time, relative to a system that doesn't incorporate wear sleeve 36, between seal failure and system breakout required for pressure sensor 48 to detect the pressure condition indicative of seal failure, allowing control signals from controller 50 to be sent to shut down pump 10 before system breakout. In some cases, wear sleeve 36 may resist breakout by only several seconds longer than without wear sleeve 36, provided that such added delay is sufficient for sensor 48 to detect the pressure condition. Because of the dynamic and intermittent nature of fluid flow through manifold 30 and pump 10, it may be difficult or impossible for sensor 48 to detect the pressure condition before breakout without the wear sleeve 36.

Wear sleeves 36 are conventionally used in high flow areas to provide long term protection against interior pipe wall erosion. For example, wear sleeves 36 have been used in locations such as at the discharge side 52 of discharge valve 24, where extreme shear pressures, turbulent fluid flow, or the redirecting by valve plug 26A of fluid flow laterally against discharge port walls 54 downstream of valve 24 may result in erosion of the discharge port walls 54 over an extended period of time if left unprotected. However, because of the high cost and generally brittle nature of wear resistant materials, such materials are not used across the entire interior surface of pump components or in flow areas expected to receive relatively little wear over time.

By contrast with conventional use of wear resistant materials and wear sleeves, the wear sleeve 36 disclosed herein is provided for short term support and is located in an area, namely the low pressure intake 18 of cylinder 14, expected to experience relatively low levels of long term wear. However, the combination of wear sleeve 36, pressure sensor 48, and controller 50 as disclosed afford effective protection against reverse jets of proppant laden fluid forming across the seal interface of valve 22.

Figure 5:
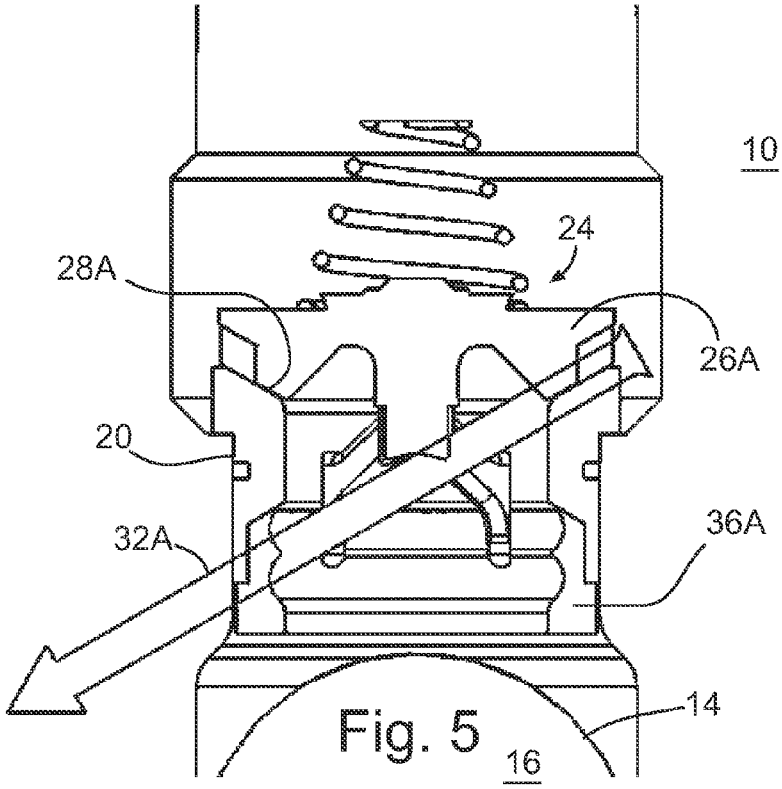
FIG. 5 is a side elevation section view of a discharge port of a cylinder in a pump block, the discharge port lined with a wear sleeve upstream of the discharge valve, and a projected path of a reverse flow jet that may form upon seal failure overlaid for reference.

Referring to FIG. 5, the discharge valve 24 may have a discharge valve plug 26A that has a closed position in which the discharge valve plug 26A is seated on a discharge valve seat 28A in the discharge port 20. In general, discharge valve 24 may have the same components and features as described above for intake valve 22, except with the addition of "A" to each corresponding reference numeral. A discharge wear sleeve 36A may line at least a portion of the discharge port 20 upstream of the discharge valve seat 28A. Wear sleeve 36A may be threaded into valve seat 28A. Discharge wear sleeve 36A may have all of the characteristics as described above for wear sleeve 36. Sleeve 36A should be designed to avoid contact with plunger 16 during pump operation.

Figure 6:
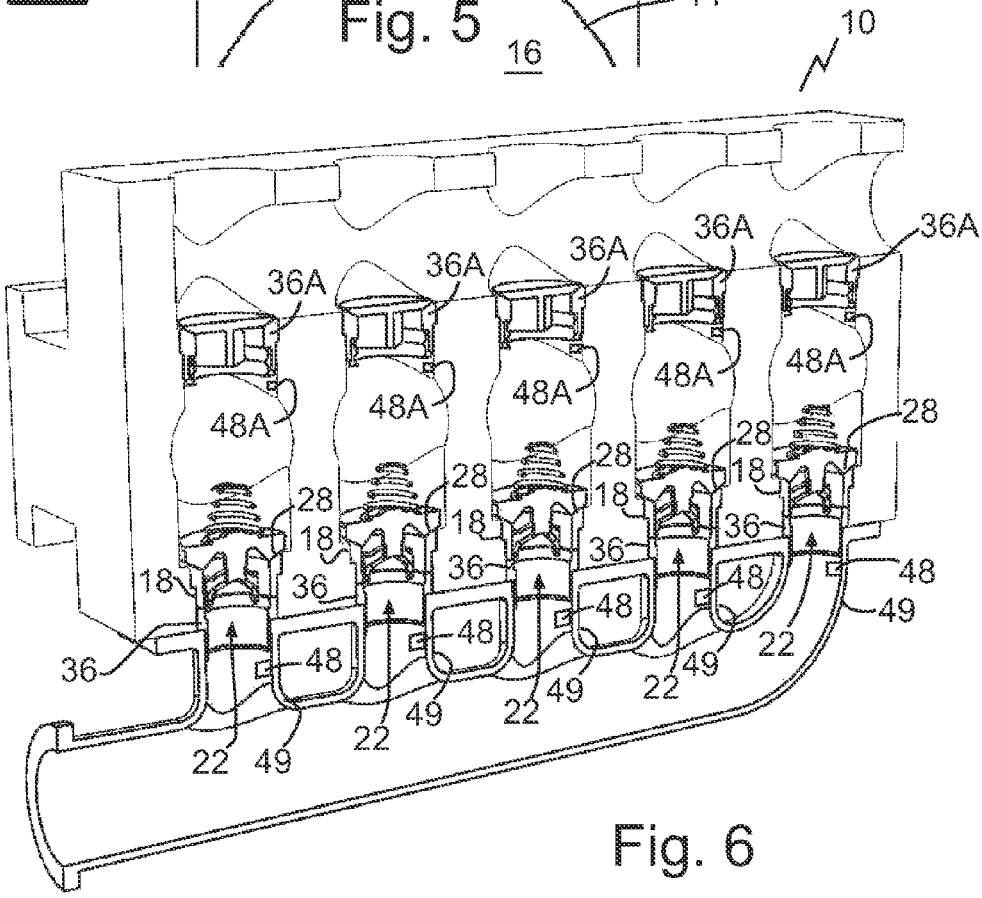
FIG. 6 is a perspective cut away view of a pump block and manifold with plural cylinders and wear sleeves positioned in each intake and discharge port.

Referring to FIG. 6, pump 10 may have plural wear sleeves 36, with each wear sleeve 36 lining at least a portion of the intake port 18 upstream of the respective valve seat 28. Pump 10 may also have plural pressure sensors 48, for example two or more, or less than or more than the number of wear sleeves 36. Each pressure sensor 48 may be located, for example within the manifold 30, upstream of the respective intake valve 22. For example, each pressure sensor 48 may be within a respective intake branch 49 of manifold 30 connected to a respective intake port 18. Other arrangements of the one or more pressure sensors 48 are possible, for example one or more pressure sensors 48 may be located in a trunk of the manifold (FIG. 2), and one or more of the plural pressure sensors 48 may be located within a respective intake port 18. In one embodiment, a single pressure sensor 48 is located in manifold 30 for sensing pressure conditions indicative of failure of two or more wear sleeves 36. In addition, each discharge port 20 may have a wear sleeve 36A and pressure transducer 48A for communicating detection of the pressure condition indicative of seal failure to controller 50 (FIG. 2).

Although described above for a fracturing operation, pump 10 may be used for other treatment operations such as gravel packing. Although valve seat 28 is described as being conically tapered, other tapered shapes may be used such as curved tapers, for example to seat a ball valve member (not shown). Although a piston or plunger type positive displacement pump is illustrated, other styles of positive displacement pump may be used, such as a progressive cavity pump. Although concave inner surfaces 40 (FIG. 3) are illustrated for wear sleeves 36, no particular shape is required, and in some case a convex or linear inner surface shape may be used. Also, in some cases a cylinder 14 may have a wear sleeve 36A in the discharge port 20 without a wear sleeve 36 in the intake port 18. In some cases the pressure sensor 48 may be positioned within or behind the wear sleeve 36 to detect sufficient puncturing of the wear sleeve 36 to alert controller 50 to shut off the pump 10. Although LPG is described as a treatment fluid, other treatment fluids may be used, such as conventional fracturing fluids including water, methanol, and diesel oil to name a few.

LPG may include a variety of petroleum and natural gases existing in a liquid state at ambient temperatures and moderate pressures. In some cases, LPG refers to a mixture of such fluids. These mixes are generally more affordable and easier to obtain than any one individual LPG, since LPGs are hard to separate and purify individually. Unlike conventional hydrocarbon based fracturing fluids, common LPGs are tightly fractionated products resulting in a high degree of purity and very predictable performance. Exemplary LPGs include propane, butane, or various mixtures thereof. As well, exemplary LPGs also include isomers of propane and butane, such as iso-butane. Further LPG examples include HD-5 propane, commercial butane, and n-butane. The LPG mixture may be controlled to gain the desired hydraulic fracturing and clean-up performance. LPG fluids used may also include minor amounts of pentane (such as i-pentane or n-pentane), higher weight hydrocarbons, and lower weight hydrocarbons such as ethane.

LPGs tend to produce excellent fracturing fluids. LPG is readily available, cost effective and is easily and safely handled on surface as a liquid under moderate pressure. LPG is completely compatible with formations, such as oil or gas reservoirs, and formation fluids, is highly soluble in formation hydrocarbons, and eliminates phase trapping—resulting in increased well production. LPG may be readily viscosified to generate a fluid capable of efficient fracture creation and excellent proppant transport. After fracturing, LPG may be recovered very rapidly, allowing savings on cleanup costs. In some embodiments, LPG may be predominantly propane, butane, or a mixture of propane and butane. In some embodiments, LPG may comprise more than 80%, 90%, or 95% propane, butane, or a mixture of propane and butane.

LPG fracturing processes may be implemented with design considerations to mitigate and eliminate the potential risks, such as by compliance with the Enform Document: Pumping of Flammable Fluids Industry Recommended Practice (IRP), Volume 8-2002, and NFPA 58 "Liquefied Petroleum Gas Code".

In the claims, the word "comprising" is used in its inclusive sense and does not exclude other elements being present. The indefinite article "a" before a claim feature does not exclude more than one of the features being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A pump, comprising:

a pump block defining a cylinder in which a piston is mounted for reciprocation and positive displacement of fluids from an intake port of the pump block to a discharge port of the pump block;

an intake valve located in the intake port of the pump block and a discharge valve located in the discharge port of the pump block;

the intake valve having a valve plug that has a closed position in which the valve plug is seated on a valve seat in the intake port;

a wear sleeve lining at least a portion of the intake port upstream of the valve seat the wear sleeve being non-integrally formed with the valve seat and being separate and distinct from the valve seat;

a pressure sensor upstream of the intake valve for detecting a pressure condition indicative of failure of the intake valve to provide a seal when the intake valve is in the closed position; and a controller responsive to the pressure sensor to send a signal to stop operation of the pump upon detection of the pressure condition, wherein the wear sleeve is disposed to intercept a set of lines, each line being tangent to the valve seat, that correspond to projected paths of a reverse flow jet that may form upon valve seal failure.

2. The pump of claim 1 in which the valve seat is conically tapered.

3. The pump of claim 1 in which the wear sleeve has a tapered inner surface.

4. The pump of claim 3 in which the tapered inner surface is concave.

5. The pump of claim 3 in which the tapered inner surface is scalloped.

6. The pump of claim 3 in which the tapered inner surface is linear.

7. The pump of claim 1 in which the discharge valve has a discharge valve plug that has a closed position in which the discharge valve plug is seated on a discharge valve seat in the discharge port and further comprising a discharge wear sleeve lining at least a portion of the discharge port upstream of the discharge valve seat.

8. The pump of claim 7 further comprising a pressure sensor upstream of the discharge valve for detecting a pressure condition indicative of failure of the discharge valve to provide a seal when the discharge valve is in the closed position.

9. The pump of claim 1 in which the pump block defines plural cylinders and respective plural intake valves and discharge valves, and further comprising a manifold connected to supply treatment fluid to each intake port.

10. The pump of claim 9 in which the pressure sensor is located within the manifold.

11. The pump of claim 10 in which the pressure sensor is located within a trunk of the manifold.

12. The pump of claim 10 in which the pressure sensor is located within an intake branch, of the manifold, connected to the intake port.

13. The pump of claim 9 in which the pressure sensor is located within the intake port.

14. The pump of claim 9 further comprising plural wear sleeves, with each wear sleeve lining at least a portion of the intake port upstream of the respective valve seat.

15. The pump of claim 14 further comprising plural pressure sensors.

16. The pump of claim 15 in which each pressure sensor is located upstream of a respective intake valve.

17. The pump of claim 15 in which one or more of the plural pressure sensors is located within the manifold.

18. The pump of claim 15 in which one or more of the plural pressure sensors is located within a respective intake port.

19. The pump of claim 1 in which the fluid is a fracturing fluid and the pump is connected to a source of the fracturing fluid.

20. The pump of claim 19 in which the fracturing fluid comprises gelled liquefied petroleum gas.

21. The pump of claim 19 in which the fracturing fluid comprises one or more of water, diesel oil, or nitrogen.

22. A pump, comprising:

a pump block defining a cylinder in which a piston is mounted for reciprocation and positive displacement of fluids from an intake port of the pump block to a discharge port of the pump block;

an intake valve located in the intake port of the pump block and a discharge valve located in the discharge port of the pump block;

the intake valve having a valve plug that has a closed position in which the valve plug is seated on a valve seat in the intake port; and a wear sleeve lining at least a portion of the intake port upstream of the valve seat the wear sleeve being non-integrally formed with the valve seat and being separate and distinct from the valve seat, wherein the wear sleeve is disposed to intercept a set of lines, each line being tangent to the valve seat, that correspond to projected paths of a reverse flow jet that may form upon valve seal failure.

* * * * *